US007607665B2

(12) United States Patent
Jordan

(10) Patent No.: US 7,607,665 B2
(45) Date of Patent: Oct. 27, 2009

(54) FISHING DART GAME

(76) Inventor: Robert S. Jordan, 8001-B Winchester Dr., Raleigh, NC (US) 27612

( * ) Notice: Subject to any disclaimer, the term of this patent is extended or adjusted under 35 U.S.C. 154(b) by 233 days.

(21) Appl. No.: 11/754,573

(22) Filed: May 29, 2007

(65) Prior Publication Data

US 2007/0278746 A1 Dec. 6, 2007

Related U.S. Application Data

(60) Provisional application No. 60/809,434, filed on May 30, 2006.

(51) Int. Cl.
*A63B 63/00* (2006.01)
*A63F 7/20* (2006.01)

(52) U.S. Cl. ..... 273/348.3

(58) Field of Classification Search ..... 273/348, 273/348.2–348.5; D21/302, 307
See application file for complete search history.

(56) References Cited

U.S. PATENT DOCUMENTS

D109,929 S * 5/1938 Rosen ..... D21/307
2,231,640 A * 2/1941 Rubin ..... 273/406
2,247,635 A * 7/1941 Illers ..... 273/380
D157,733 S * 3/1950 Burton ..... D21/307
3,026,110 A * 3/1962 Hess et al. ..... 473/570
3,428,320 A * 2/1969 Yurkinas ..... 273/348.2
3,504,913 A * 4/1970 Anthony ..... 273/407
4,030,736 A * 6/1977 Petrusek ..... 273/348.3
4,305,587 A * 12/1981 O'Grady ..... 273/348.3
4,681,325 A * 7/1987 Sheem ..... 273/348.3
5,110,136 A * 5/1992 Land ..... 273/348.4
5,139,272 A * 8/1992 Villafuerte ..... 273/348.3
D334,034 S * 3/1993 Larsen ..... D21/307
5,377,990 A * 1/1995 Seeney-Sullivan ..... 273/236
5,603,504 A * 2/1997 Powell ..... 273/348.4
5,722,663 A * 3/1998 Avigal et al. ..... 273/448
5,871,214 A * 2/1999 Hummel ..... 273/348.4
6,116,605 A * 9/2000 Davey, III ..... 273/348.3
2007/0278746 A1 * 12/2007 Jordan ..... 273/348.3

* cited by examiner

*Primary Examiner*—Raleigh W. Chiu
(74) *Attorney, Agent, or Firm*—Coats & Bennett, P.L.L.C.

(57) ABSTRACT

A magnetic dart game comprises a magnetic target having a graphical representation of a plurality of fish and at least one magnetic dart. A player playing the game attempts to catch said plurality of fish by hitting the fish with the magnetic dart.

4 Claims, 2 Drawing Sheets

FISHING DART GAME

RELATED APPLICATIONS

The present application claims priority under 35 U.S.C. 119(e) to prior provisional application Ser. No. 60/809,434 filed May 30, 2006 titled Magnetic Fishing Dart Game, which is incorporated herein in its entirety by reference.

BACKGROUND

The present invention relates to magnetic dart games and, more particularly, to magnetic dart games that simulate sporting events and outdoor activities.

In the conventional game of darts, darts are thrown at a target that is divided into sectors. Each sector is associated with a value that is added to a player's score if the player hits that sector. The players throw darts in turns and keep a cumulative score. The first player to reach a predetermined score, or the player with the highest score after a predetermined number of turns, wins the game.

While the game of darts is a popular pastime, game play can become monotonous. In order to provide more interest and more variety in game play, the present invention provides a magnetic dart game and method of playing the same to simulate various sports and outdoor activities.

SUMMARY

The present invention provides a magnetic dart game and method of playing a magnetic dart game to simulate the sport of fishing. The magnetic dart game comprises a magnetic target having a pictorial representation of a plurality of fish. A player playing the game attempts to catch the fish by hitting the fish with a magnetic dart thrown from an agreed upon position.

In one embodiment, the target further includes a graphical representation of bait. Hitting the bait with a dart "baits the hook" and entitles the player to catch a fish. The player must "bait the hook" before being entitled to catch a fish. The fish may include sweet spots that, if hit by a player, entitles the player to catch the next fish without first hitting the bait.

In one embodiment the target further includes a graphical representation of a predator. Hitting the predator causes a player to lose the bait and/or the last fish that was caught by the player.

DETAILED DESCRIPTION

Figure 1:
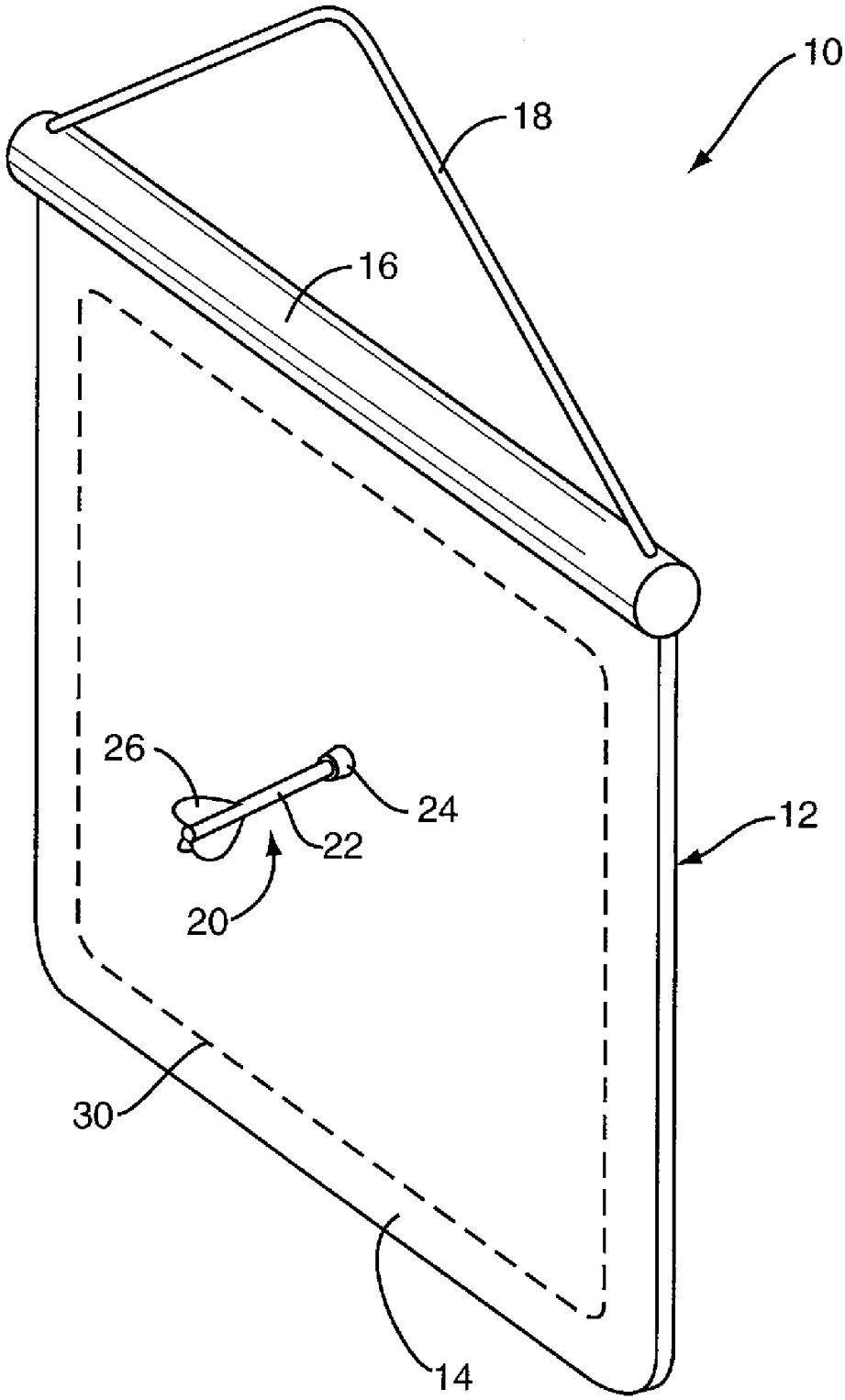
FIG. 1 is a perspective view of a magnetic dart game according to one exemplary embodiment of the present invention.

Referring now to the drawings, the present invention comprises magnetic dart game 10 including a target 12 and a plurality of magnetic darts 20. The target 12 comprises a flexible magnetic mat 14 having an image of a playing field, court, track, or course printed thereon. The precise nature of the image will depend upon the sport that is simulated. The mat 14 may have a fabric covering (not shown) if desired. The mat 14 may be attached along one edge to a scroll 16 so that the mat 14 can be rolled around the scroll 16 for storage or shipment. A cord or string 18 may be attached at each end to the scroll 16 for hanging the target 12.

Each player is provided with three darts 20, though a different number could also be used. The darts 20 for each player are preferably a different color, or have some other distinguishing characteristic. Each dart 20 comprises a shaft 22 with a magnetic tip 24 at one end and fins 26 at the opposite end.

Figure 2:
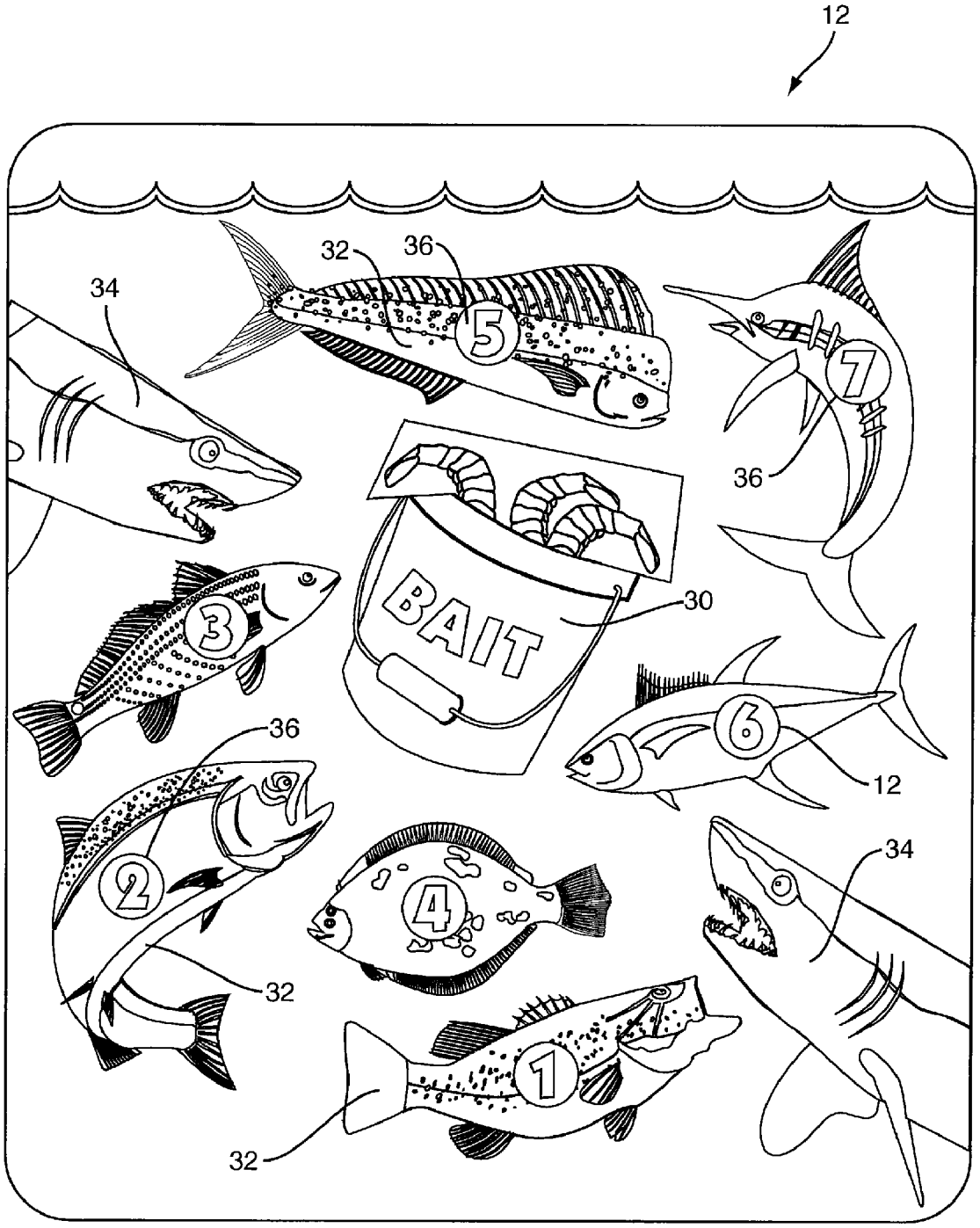
FIG. 2 is a plan view of a magnetic target for simulating a round of golf.

FIG. 2 illustrates one exemplary embodiment of the target 12 for simulating the sport of fishing. The target 12 includes a water line printed thereon to simulate a body of water such as an ocean, lake, or river. The target 12 includes images of bait 30 and a plurality of aquatic creatures aquatic creatures 32, 34 surrounding the bait 30. The precise nature of the images will depend upon the type of aquatic creatures 32, 34 and/or bait 30 that is simulated. In the embodiment shown in FIG. 2, the aquatic creatures comprise various fish 32 and sharks 34 or other predators, while the bait 30 comprises a bucket of shrimp. However, other types of aquatic creatures 32, 34 and/or bait 30 may be printed on the target 12 in addition to or in lieu of those seen in FIG. 2. Each fish 32 includes a sweet spot 36, which in this embodiment is a one-inch red circle printed on the fish. Each sweet spot 36 further includes a number.

Players take turns trying to catch each fish 32 in sequence. The players throw three darts 20 during each turn. For each fish 32, the player must first hit the bait 30 with a dart to "bait 30 the hook," and then attempt to hit a fish 32. In one variation, different types of bait 30 may be provided for different types of fish 32. A fish 32 may be considered to be hit (caught) when half of a dart is on the fish 32. If a player hits the sweet spot 36 while attempting to catch that fish 32, the player does not have to hit the bait 30 to catch the next fish 32. The first player to catch all the fish 32 printed on the mat wins the game.

Players do not try to hit a shark 34 with their darts. If a player hits a shark 34, that player is penalized by losing the bait 30 off his hook and his last fish 32 caught. By way of example, if a player hits a shark 34 while attempting to catch his fourth fish 32, that player loses his bait 30 and his third fish 32 caught. Likewise, if a player hits a shark 34 while attempting to hit the bait 30 to bait 30 the hook to catch the fourth fish 32, that player loses his third fish 32 caught as well as the bait 30 used to catch the third fish 32. In either case, that player must once again hit the bait 30 and catch the third fish 32. However, if a player hits a shark 34 immediately after hitting the sweet spot 36 on a given fish 32, that player loses only the last fish 32 caught.

Many variation of the game are possible. For example, the fish 32 can be assigned values and that are added to accumulate a score. The values may correspond, for example, to the weight of the fish 32. In this embodiment, a fish 32 cannot be caught more than once. The player that accumulates the highest accumulated score after a predetermined number of throws wins.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of playing a magnetic dart game, said method comprising:

throwing magnetic darts at a magnetic target having graphical representations of a plurality of fish and a graphical representation of bait; and catching said plurality of fish by hitting said bait and subsequently hitting said fish with darts thrown by a player.

2. The method of claim 1 wherein the graphical representation of said plurality of fish includes at least one sweet spot on each fish, and wherein hitting a sweet spot on a fish with a dart entitles a player to catch the next fish without first hitting the bait.

3. The method of claim 1 wherein the magnetic target further comprises a graphical representation of at least one predator, and wherein hitting a predator with a dart causes a player to lose the last fish caught by the player.

4. The method of claim 1 wherein the game continues until a player catches a predetermined number of fish.

* * * * *